US005760351A

United States Patent [19]

Tsai

[11] Patent Number: 5,760,351

[45] Date of Patent: Jun. 2, 1998

[54] RUBBER CONE LAYER OF A KEYBOARD

[75] Inventor: Ching-Cheng Tsai, Keelung, Taiwan

[73] Assignee: Chicony Electronics Co., Ltd., Taipei Hsien, Taiwan

[21] Appl. No.: 634,237

[22] Filed: Apr. 18, 1996

[51] Int. Cl.[6] ..... H01H 13/70; H01H 1/10

[52] U.S. Cl. ..... 200/5 A; 200/512

[58] Field of Search ..... 200/5 A, 54, 345, 200/512, 516, 517; 400/490

[56] References Cited

U.S. PATENT DOCUMENTS

| | | | |
|---|---|---|---|
| 4,354,068 | 10/1982 | Sobol, III | 200/5 A |
| 4,701,579 | 10/1987 | Kurachi et al. | 200/5 A |
| 5,246,512 | 9/1993 | Seki et al. | 200/265 |
| 5,286,937 | 2/1994 | Santo et al. | 200/516 |
| 5,418,530 | 5/1995 | Moor et al. | 341/22 |
| 5,565,865 | 10/1996 | So | 341/20 |

*Primary Examiner*—Adolf Berhane
*Assistant Examiner*—Rajnikant B. Patel
*Attorney, Agent, or Firm*—Morton J. Rosenberg; David I. Klein; Jun Y. Lee

[57] ABSTRACT

A rubber cone layer for use in a computer keyboard, having fine grains distributed over the top and bottom sides thereof to prevent sticking to the membrane circuit of the computer keyboard, and a plurality of rubber cones raised from the top side corresponding to the key switches of the computer keyboard for compression by the key switches to trigger respective contact points at the membrane circuit, each of the rubber cones having a downward plunger terminating in a conductive element and spaced above one contact point of the membrane circuit.

2 Claims, 7 Drawing Sheets

RUBBER CONE LAYER OF A KEYBOARD

BACKGROUND OF THE INVENTION

The present invention relates to keyboards, and relates more specifically to the rubber cone layer of a keyboard which has a roughened surface that eliminates the formation of a vacuum, and can be conveniently stripped off the mold without the application of a stripping agent.

Following the fast development of high technology, computer has become more and more important in our daily life. Therefore, using a keyboard for data entry has become a part of the routine works of most people's daily life. Consequently, the requirement of the quality of keyboards in appearance, sense of touch, operation sound, etc., is relatively critical. FIG. 1 shows the structure of a regular computer keyboard. This structure of computer keyboard is comprised of a cover shell (1*a*), a set of key switches (2*a*), a frame (3*a*), a rubber cone layer (4*a*), a membrane circuit (5*a*), and a bottom shell (6*a*). The rubber cone layer (4*a*) is molded from rubber and mounted between the frame (3*a*) and the membrane circuit (5*a*), having a plurality of rubber cones (40*a*) corresponding to the key switches (2*a*). When assembled, the plungers (not shown) of the key switches (2*a*) are respectively stopped above the rubber cones (40*a*) of the rubber cone layer (4*a*). When one key switch (2*a*) is depressed, the corresponding rubber cone (40*a*) is compressed and forced downwards to trigger the membrane circuit (5*a*), causing it to produce a respective electrical signal. When the key switch (2*a*) is released, the corresponding rubber cone (40*a*) immediately returns to its former shape to push the key switch (2*a*) back to its former position. Because the bottom side of the rubber cone layer (4*a*) and the top side of the membrane circuit (5*a*) are smooth surfaces, a vacuum tends to be produced between the rubber cone layer (4*a*) and the membrane circuit (5*a*) during the operation of the keyboard, causing the rubber cone layer (4*a*) and the membrane circuit (5*a*) to be stuck together. Furthermore, because the both sides of the rubber cone layer (4*a*) are made smooth, a stripping agent must be applied to the mold during the molding process of the rubber cone layer (4*a*) so that the rubber cone layer (4*a*) can be easily removed from the mold when molded. However, the use of a stripping agent will causes an air pollution. When removing the rubber cone layer (4*a*) from the mold, a current of compressed air shall be driven into the mold to force the rubber cone layer (*a*) away. Even all measures have been employed, the rubber cone layer (4*a*) may be stretched to break by an error during the stripping procedure.

SUMMARY OF THE INVENTION

The present invention has been accomplished to provide a rubber cone layer for keyboards which eliminates the aforesaid problems. According to one aspect of the present invention, the rubber cone layer has fine grains distributed over the top and bottom sides thereof to prevent sticking to the membrane circuit of the computer keyboard, and to facilitate its removal from the mold during its fabrication, and a plurality of rubber cones raised from the top side corresponding to the key switches of the computer keyboard for compression by the key switches of the computer keyboard to trigger respective contact points at the membrane circuit. According to another aspect of the present invention, each of the rubber cones has a downward plunger terminating in a conductive element and adapted for triggering a corresponding contact point of the membrane circuit.

DETAILED DESCRIPTION OF THE PREFERRED EMBODIMENT

Figure 1:
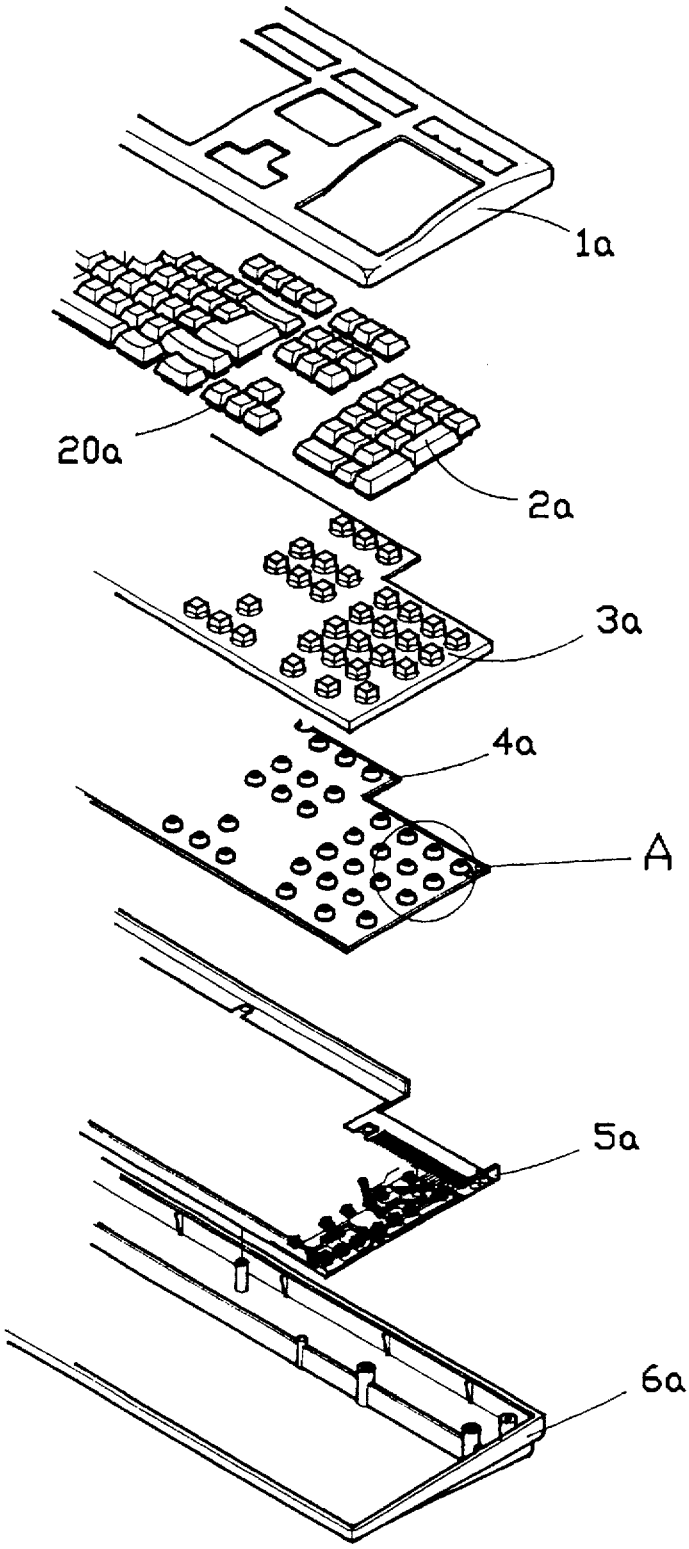
FIG. 1 is an exploded view of a regular computer keyboard.
Figure 1A:
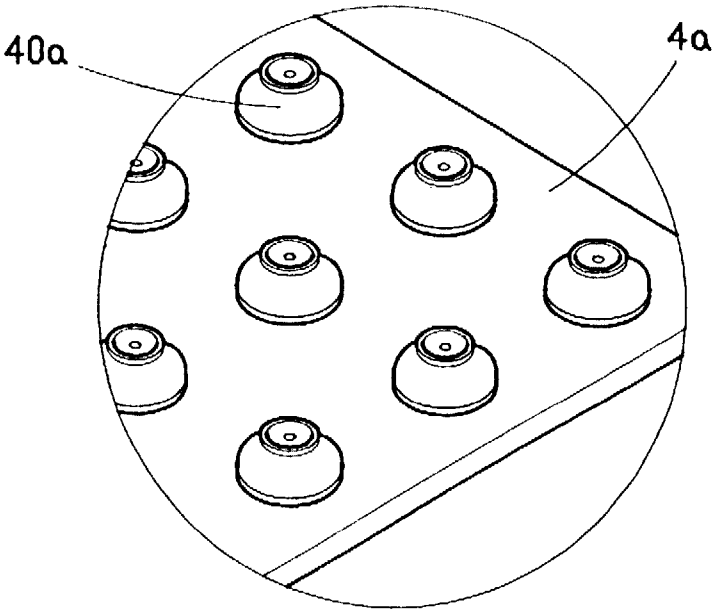
FIG. 1A is an enlarged view of a part of the rubber cone layer shown in FIG. 1.
Figure 2:
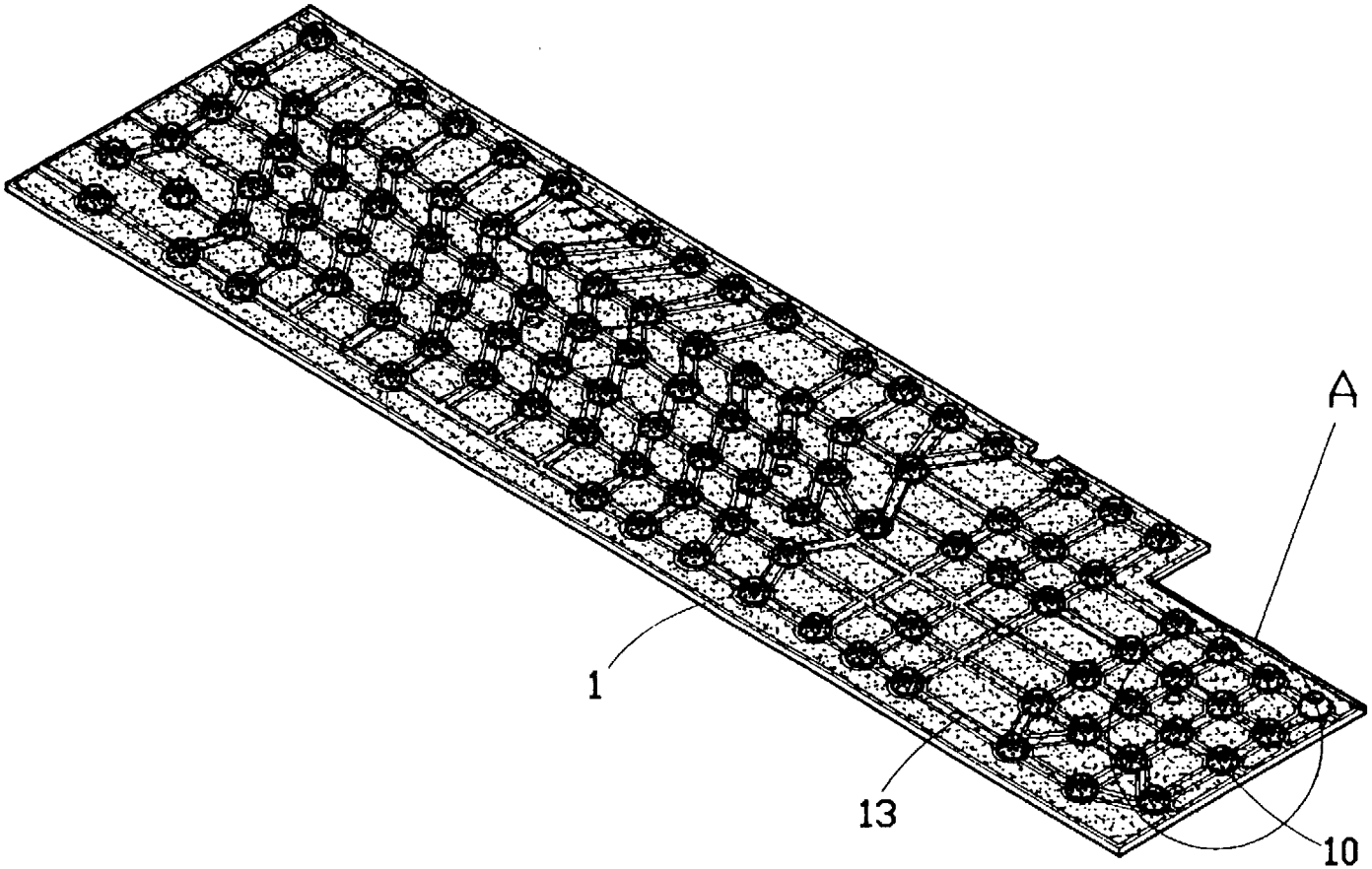
FIG. 2 is an elevational view of a rubber cone layer according to the present invention.
Figure 2A:
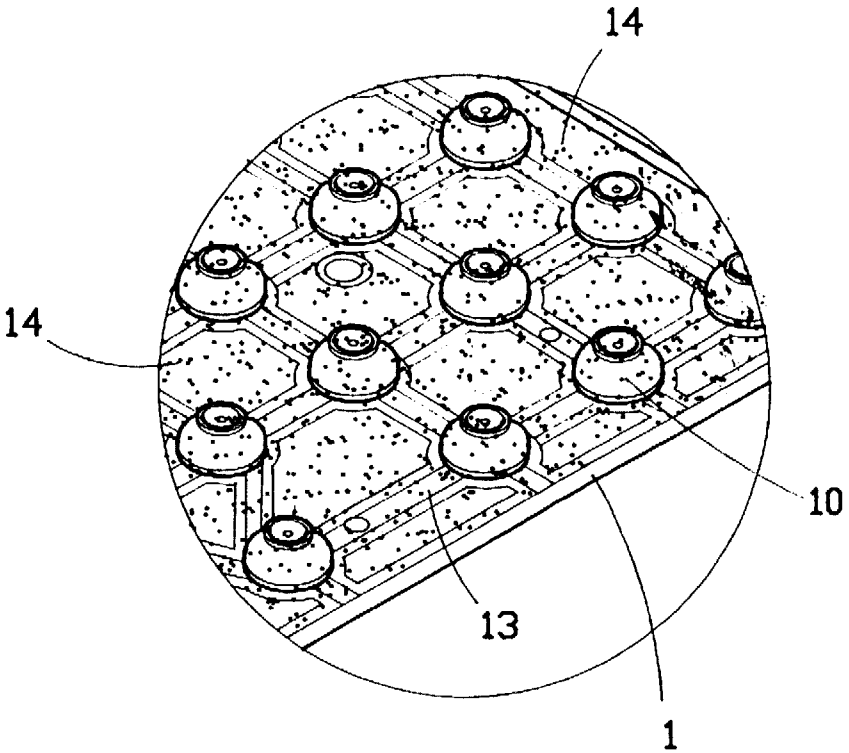
FIG. 2A is an enlarged view of a part of the rubber cone layer shown in FIG. 2.
Figure 3:
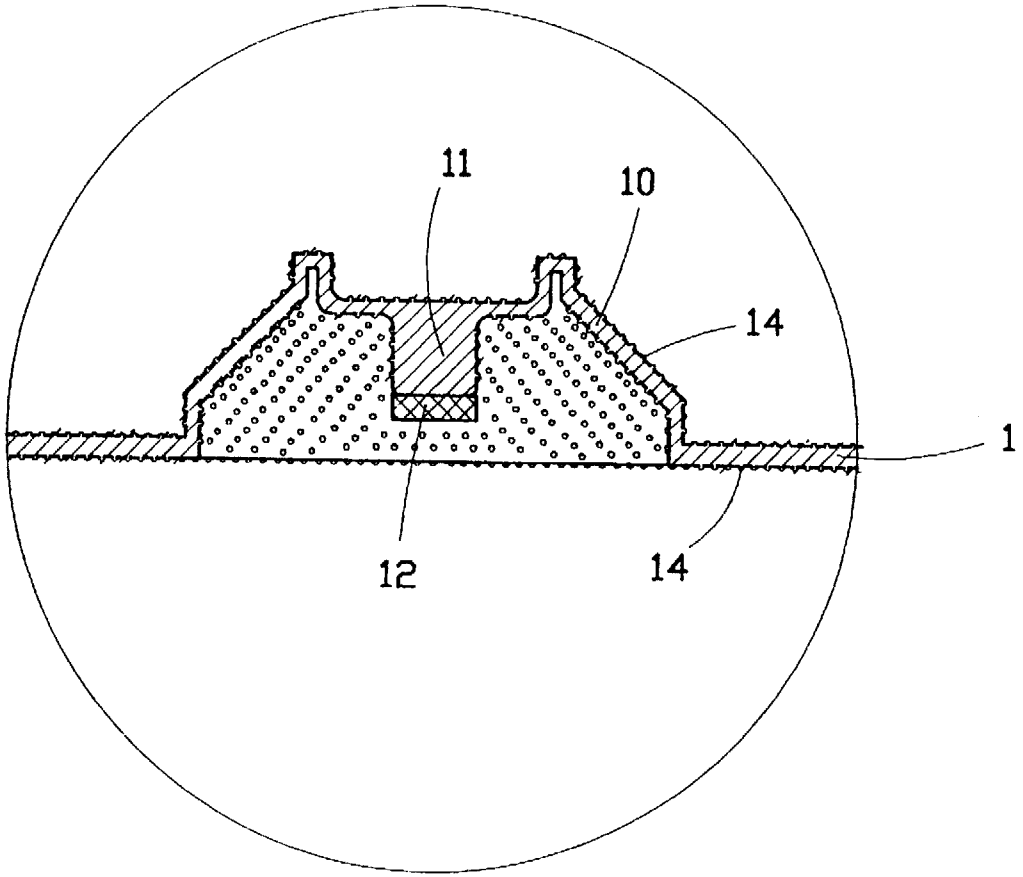
FIG. 3 is a sectional plain view in an enlarged scale of one rubber cone of the rubber cone layer shown in FIG. 2.

Referring to FIGS. 2, 2A, and 3, the rubber cone layer, referenced by 1, is a flat sheet of rubber having a plurality of rubber cones 10 raised from the top side, and a plurality of fine grains 14 raised from the top side and the bottom side, including the both sides of each of the rubber cones 10. Because of the fine grains 14, the top and bottom sides of the rubber cone layer 1 form a respective roughened surface. The rubber cones 10 are of hollow structure, each comprising a downward plunger 11 and a conductive element 12 at the end of the downward plunger 11. Furthermore, a plurality of air ditches 13 are formed in the bottom side of the rubber cone layer 1 for exhaust of air.

Figure 4:
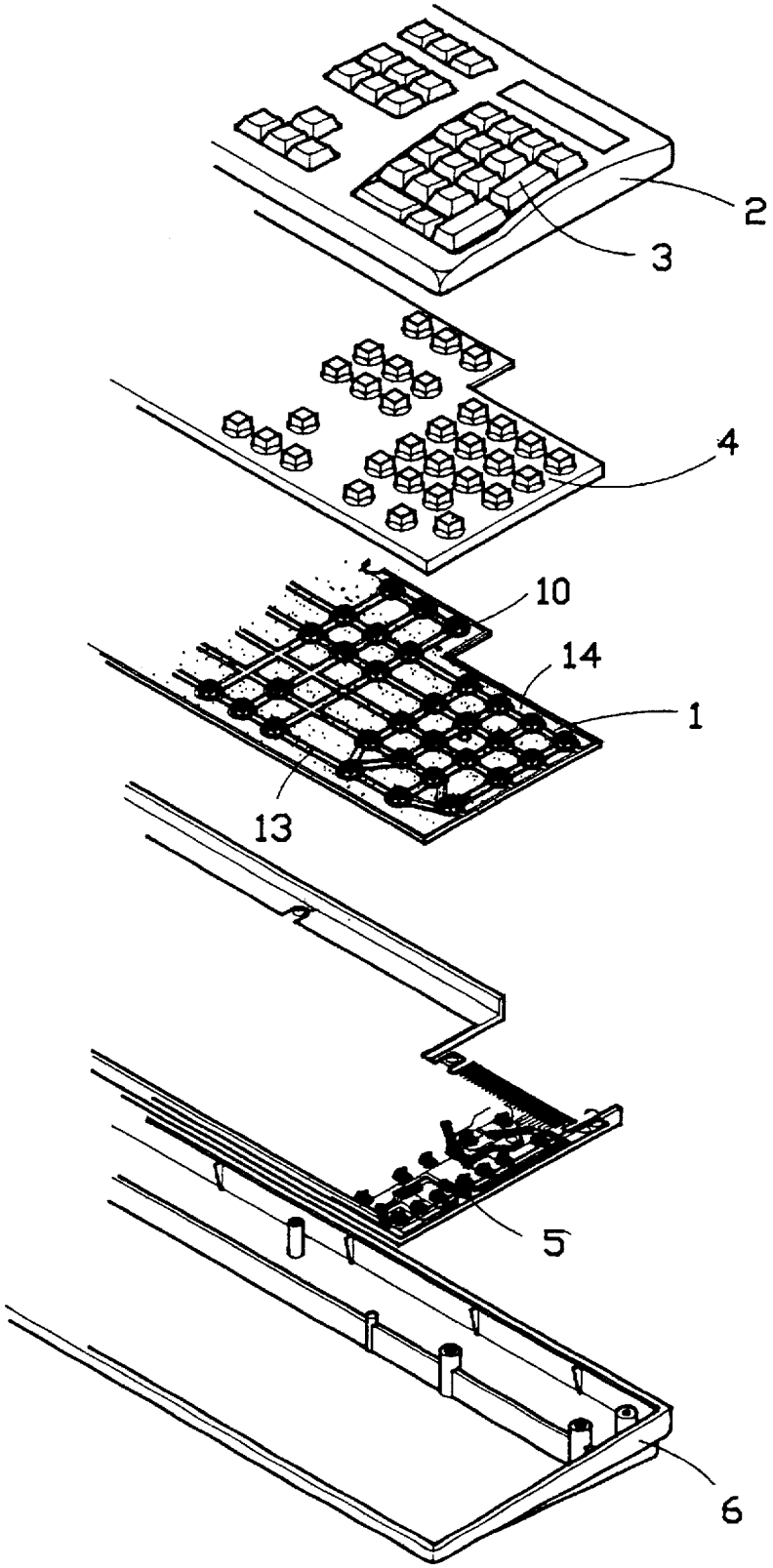
FIG. 4 is an exploded view of a computer keyboard according to the present invention.
Figure 5:
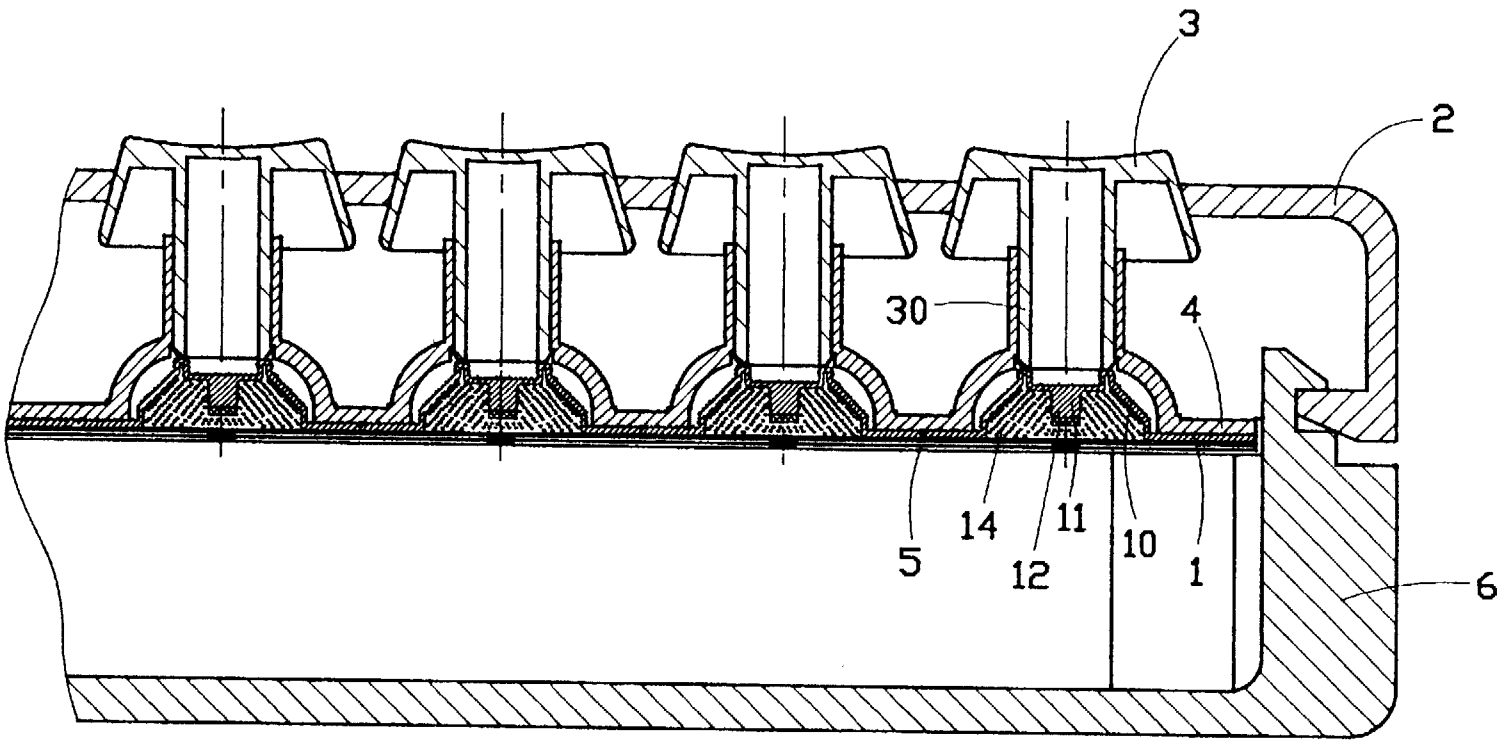
FIG. 5 is a sectional assembly view of the computer keyboard shown in FIG. 4.

Referring to FIGS. 4 and 5, a keyboard in accordance with the present invention is comprised of a cover shell 2, a set of key switches 3, a frame 4, a rubber cone layer 1, a membrane circuit 5, and a bottom shell 6. The rubber cone layer 1 is mounted between the frame 4 and the membrane circuit 5 and covered within the cover shell 2 and the bottom shell 6, and the rubber cones 10 and respectively disposed beneath the plungers 30 of the key switches 3. When one key switch 3 is depressed, the corresponding rubber cone 10 is compressed and forced downwards to trigger the membrane circuit 5, causing it to produce a respective electrical signal. When the key switch 3 is released, the corresponding rubber cone 10 immediately returns to its former shape to push the key switch 3 back to its former position. Because the both sides of the rubber cone layer 1 have fine grains 14 it does not stick to the membrane circuit 5 when compressed. The design of the fine grains 14 enables the rubber cone layer 1 to be quickly removed from the mold during its fabrication, and the use of a stripping agent can be eliminated. As an alternate form of the present invention, the fine grains 14 may be formed on one side for example the top or bottom side of the rubber cone layer 1 only.

It is to be understood that the drawings are designed for purposes of illustration only, and are not intended as a definition of the limits and scope of the invention disclosed.

What the invention claimed is:

1. A rubber cone layer for use in a computer keyboard, comprising a top side, a bottom side, and a plurality of rubber cones raised from said top side corresponding to a respective plurality of key switches of the computer keyboard, and adapted to be compressed by the key switches to trigger a membrane circuit of the computer keyboard at respective contact points corresponding to the key switches, wherein said rubber cone layer has a plurality of fine grain shaped projections extending from and distributed over a surface of at least one of said top side for forming a roughened surface thereon and said bottom side, each of said rubber cones having a downward plunger terminating in a conductive element and spaced above one contact point of the membrane circuit.

2. A rubber cone layer for use in a computer keyboard, comprising a top side, a bottom side, and a plurality of rubber cones raised from said top side corresponding to a respective plurality of key switches of the computer keyboard, and adapted to be compressed by the key switches to trigger a membrane circuit of the computer keyboard at respective contact points corresponding to the key switches, wherein said rubber cone layer has a plurality of fine grains shaped projections extending from and distributed over surfaces of both the bottom side of said rubber cone layer and the top side thereof for forming a roughened surface thereon, each of said rubber cones having a downward plunger terminating in a conductive element and spaced above one contact point of the membrane circuit.

* * * * *